US008722552B2

(12) United States Patent
Kanatani

(10) Patent No.: US 8,722,552 B2
(45) Date of Patent: May 13, 2014

(54) WOVEN/KNIT FABRIC WITH REVERSIBLE AIR PREMEABILITY AND PRODUCTION PROCESS THEREOF

(75) Inventor: Shoji Kanatani, Toyohashi (JP)

(73) Assignees: Mitsubishi Rayon Co., Ltd., Tokyo (JP); Mitsubishi Rayon Textile Co., Ltd., Osaka-shi (JP)

( * ) Notice: Subject to any disclaimer, the term of this patent is extended or adjusted under 35 U.S.C. 154(b) by 1137 days.

(21) Appl. No.: 11/994,499

(22) PCT Filed: Jun. 30, 2006

(86) PCT No.: PCT/JP2006/313149
§ 371 (c)(1),
(2), (4) Date: Jan. 3, 2008

(87) PCT Pub. No.: WO2007/004589
PCT Pub. Date: Jan. 11, 2007

(65) Prior Publication Data

US 2009/0029616 A1 Jan. 29, 2009

(30) Foreign Application Priority Data

Jul. 5, 2005 (JP) ..... 2005-195745

(51) Int. Cl.

| | |
|---|---|
| ***D03D 15/04*** | (2006.01) |
| ***D04B 1/14*** | (2006.01) |
| ***D04B 1/22*** | (2006.01) |
| ***D02G 3/02*** | (2006.01) |
| ***D02G 3/04*** | (2006.01) |
| ***D04B 21/20*** | (2006.01) |

(52) U.S. Cl.
USPC ..... 442/189; 442/197; 442/307; 442/310; 428/373; 428/374; 428/369; 428/370

(58) Field of Classification Search
USPC ..... 428/373, 374, 369, 370; 442/189, 197, 442/307, 310
See application file for complete search history.

(56) References Cited

FOREIGN PATENT DOCUMENTS

| | | |
|---|---|---|
| JP | 7-252743 | 10/1995 |
| JP | 2829893 | 9/1998 |
| JP | 2002-180323 | 6/2002 |
| JP | 2003-41462 | 2/2003 |
| JP | 2003-147655 | 5/2003 |
| JP | 2004-308074 | 11/2004 |
| JP | 2005-23431 | 1/2005 |
| JP | 2005-36374 | 2/2005 |
| JP | 2006-132010 | 5/2006 |
| WO | WO 2004/113601 A1 | 12/2004 |

OTHER PUBLICATIONS

JP 2003-147655. Baba et al. May 21, 2003. English Translation.*
JP 2002-180323. Kuroda et al. Jun. 26, 2002. English Translation.*
Extended Search Report issued Feb. 10, 2011, in European Patent Application No. 06780706.5-2314/1921187.

* cited by examiner

*Primary Examiner* — Jenna Johnson
(74) *Attorney, Agent, or Firm* — Oblon, Spivak, McClelland, Maier & Neustadt, L.L.P.

(57) ABSTRACT

This woven/knit fabric contains composite yarn comprising a multifilament yarn A2 and a multifilament yarn B2, which satisfies the following conditions (1) to (3):

(1) the ratio (WA2/DA2) of the yarn length of the multifilament fiber A2 during absorption of moisture and humidity (WA2) to the yarn length of the multifilament yarn A2 under conditions of 20° C. and 65% humidity (DA2) is 1.02 to 1.30;

(2) the ratio (WA2/DB2) of the yarn length of the multifilament yarn A2 during absorption of moisture and humidity (WA2) to the yarn length of the multifilament yarn B2 under conditions of 20° C. and 65% humidity (DB2) is 0.9 to 1.1; and (3) the drying shrinkage stress (DS value) of the multifilament yarn A2 is 0.08 cN/dtex or more.

10 Claims, No Drawings

WOVEN/KNIT FABRIC WITH REVERSIBLE AIR PREMEABILITY AND PRODUCTION PROCESS THEREOF

TECHNICAL FIELD

The present invention relates to a woven/knit fabric in which the air permeability thereof changes reversibly and to a production process thereof.

The present application claims priority on Japanese Patent Application No. 2005-195745 filed on Jul. 5, 2005, the content of which is incorporated herein by reference.

BACKGROUND ART

Fashion trends and consumer needs have become extremely diversified in recent years, and it is becoming necessary to provide woven/knit fabrics offering further improvement of texture, specialized functions, and the like in response to consumer preferences. One of these specialized functions that is particularly desired enables the air permeability of clothing to reversibly change according to changes in temperature and humidity within the clothing, thereby making it possible to control temperature and humidity within clothing and continuously adjust temperature and humidity to a comfortable state, and numerous such functions have been proposed.

Patent Document 1, for example, proposes a textile material that uses acetone side-by-side conjugate fibers in which air permeability changes by using a material in which percentage of crimp changes according to humidity. In addition, Patent Document 2 proposes a textile material that uses denatured polyethylene terephthalate and Nylon side-by-side conjugate fibers. Both of these examples of the prior art are composed of side-by-side conjugate fibers of two components having different moisture and water absorbability, and utilize a reversible change in the crimped form of the yarn when dry and when moisture and water have been absorbed. However, since the moisture and water absorbability of polyester and Nylon are each inadequate, the change in form of these textile materials attributable to moisture or water is small, thereby resulting in an inadequate change in air permeability of these textile materials.

Patent Document 3 proposes a woven/knit fabric that improves air permeability during absorption of moisture and humidity by making the difference in yarn length when dry between absorbent self-stretching yarn and non-self-stretching yarn to be 90% or less in a combination with non-self-stretching yarn using elastic fibers in the form of special polyether ester fibers for the absorbent self-stretching yarn. However, it is difficult to carry out this invention unless the absorbent self-stretching yarn consists of elastic fibers in order to impart such an extreme difference in yarn length as required in the technique defined in this invention.

For example, if the absorbent self-stretching yarn consists of elastic fibers, when weaving/knitting is carried out by aligning the absorbent self-stretching yarn with the non-self-stretching yarn while drafting (stretching), the yarn length becomes shorter due to the appearance of the elastic recovery characteristics of the elastic fibers, thereby allowing the obtaining of a prescribed difference in yarn length. However, this is not possible unless elastic fibers having a elastic recovery characteristics following drafting (stretching) are selected for the absorbent self-stretching yarn. Moreover, even if the raw yarn has a difference in yarn length, simply manufacturing a woven/knit fabric does not allow the obtaining of adequate air permeability improvement effects.

Patent Document 4 proposes a woven/knit fabric that uses a composite yarn comprising hydrophilic cellulose-based fibers generally known to exhibit swelling phenomena in the presence of moisture, and hydrophobic fibers in the form of polyester fibers and the like, wherein as a result of distributing a polyester filament having high heat shrinkage characteristics on the inside of the composite yarn and arranging a hydrophilic rayon filament on the outside of the composite yarn as a result of heat treatment by dyeing, the fabric changes to a warm texture due to the dimensional stability of the fabric and piles having a crimped wave protruding from the surface of the fabric, and air within the fabric is allowed to enter and leave due to a reversible change in the air content (specific volume) of the fabric attributable to swelling and deswelling of the rayon. However, in contrast to the rayon swelling during absorption of moisture and humidity, since the polyester filament distributed in the core of the composite yarn does not swell, the apparent fabric space (apparent voids between the composite yarn used in the fabric (fabric opening)) decreases, thereby inhibiting air permeability during absorption of moisture and water.

Patent Document 5 proposes a regenerated cellulose-polyester mixed-weave interlaced composite filament in which spontaneously stretching polyester fibers are distributed on the outside by dyeing for the purpose of preventing stickiness when perspiring. However, since regenerated cellulose swells during absorption of moisture and water due to dyeing, and is easily set by dry shrinkage as a result of dry finishing, even if the same yarn composition is used as a woven/knit fabric, mutual yarn length when preparing a woven/knit fabric changes depending on tentering and other conditions. In addition, in this proposal, there is no mention made of a production process for imparting the mutual difference in yarn length required to obtain a woven/knit fabric demonstrating reversible air permeability when moisture and water are absorbed, and the object is different from that of the present application.

Patent Document 1: Japanese Unexamined Patent Application, First Publication No. 2002-180323

Patent Document 2: Japanese Unexamined Patent Application, First Publication No. 2003-41462

Patent Document 3: Japanese Unexamined Patent Application, First Publication No. 2005-36374

Patent Document 4: Japanese Unexamined Patent Application, First Publication No. 7-252743

Patent Document 5: Japanese Unexamined Patent Application, First Publication No. 2003-147655

DISCLOSURE OF THE INVENTION

An object of the present invention is to solve the problems of the prior art as described above by providing a woven/knit fabric with reversible air permeability that allows the obtaining of a large change in air permeability caused by a change in water and moisture content, while also having superior water absorption property, moisture absorption property and rapid-drying, and providing a production process thereof.

As a result of conducting extensive studies on the yarn structure of woven/knit fabrics during absorption of moisture and water, and particularly differences in yarn length in composite yarn, the inventors of the present invention found that the aforementioned problems can be solved by the composition described below.

A first aspect of the present invention is a woven/knit fabric containing composite yarn comprising a multifilament yarn A2 and a multifilament yarn B2, which satisfies the following conditions (1) to (3):

(1) the ratio (WA2/DA2) of the yarn length of the multifilament fiber A2 during absorption of moisture and water (WA2) to the yarn length of the multifilament yarn A2 under conditions of 20° C. and 65% humidity (DA2) is 1.02 to 1.30;

(2) the ratio (WA2/DB2) of the yarn length of the multifilament yarn A2 during absorption of moisture and water (WA2) to the yarn length of the multifilament yarn B2 under conditions of 20° C. and 65% humidity (DB2) is 0.9 to 1.1; and (3) the drying shrinkage stress (DS value) of the multifilament yarn A2 is 0.08 cN/dtex or more.

In addition, a second aspect of the present invention is a process for producing a woven/knit fabric comprising: forming a woven/knit fabric using a composite yarn comprising a multifilament yarn A1 and a multifilament yarn B1, carrying out dyeing treatment on the woven/knit fabric at 100 to 130° C., and carrying out thermosetting at 100 to 200° C.

According to the present invention, a woven/knit fabric with reversible air permeability is obtained that is capable of maintaining a comfortable environment inside clothing by preventing the inside of clothing from becoming hot and steamy when perspiring and preventing stickiness and a rise in temperature by increasing air permeability in the case of an increase in the water content of a woven/knit fabric due to absorption of moisture and water, and by preventing an excessive decrease in body temperature due to heat of vaporization by changing air permeability to the original air permeability after the woven/knit fabric has released moisture to the outside environment.

BEST MODE FOR CARRYING OUT THE INVENTION

The composite yarn contained in the woven/knit fabric of the present invention is composed of a multifilament yarn A2 and a multifilament yarn B2, and the multifilament yarn A2 and the multifilament yarn B2 are respectively a yarn that has undergone all of the steps of compounding, weaving/knitting, dyeing, and thermosetting. Furthermore, yarns prior to completion of thermosetting are designated as multifilament yarn A' and multifilament yarn B', respectively.

The multifilament yarn A2 is required to be a multifilament yarn having reversible stretchability in which it stretches to 1.02 to 1.30 times its length when dry during absorption of moisture and water and returns to its original length when dry. On the other hand, the multifilament yarn B2 preferably undergoes a change in yarn length between the length when dry and the length during absorption of moisture and water of ±1% or less, and more preferably does not undergo any change in yarn length when dry and during absorption of moisture and water.

In the present invention, if the stretching ratio of yarn length during moisture and humidity absorption to yarn length when dry of the multifilament yarn A2 is less than 1.02, the opening of the woven/loop of knit fabric during absorption of moisture and water does not sufficiently become large and the effect of improving air permeability is not obtained. In addition, if the stretching ratio exceeds 1.30, dimensional stability during absorption of moisture and water becomes poor. Moreover, as a result of the multifilament yarn A2 demonstrating reversible stretching, the inside of clothing can be maintained in a comfortable state both when dry and during absorption of moisture and water.

When the multifilament yarn B2 shrinks by more than 1% as a result of a change in yarn length during absorption of moisture and water as compared with that when dry, the stretching of the multifilament yarn A2 is impaired, thereby easily impairing the effect of improving air permeability. In addition, when the multifilament yarn B2 stretches by more than 1% as a result of a change in yarn length during absorption of moisture and water as compared with that when dry, the opening of the woven/loop of knit fabric during absorption of moisture and water becomes excessively large, thereby resulting in increased susceptibility to inferior dimensional stability of the woven/knit fabric.

In addition, in the present invention, the ratio WA2/DB2 of the yarn length of the multifilament yarn A2 during absorption of moisture and water (WA2) to the yarn length of the multifilament yarn B2 when dry (DB2) is required to be within the range of 0.9 to 1.1, the ratio WA2/DB2 in the state in which stretching of the multifilament yarn A2 during absorption of moisture and water is unlikely to be impaired by the multifilament yarn B2 compounded in a state of being longer than the multifilament yarn A2 is preferably within the range of 0.9 to 1.0, and mutual yarn lengths of the multifilament yarn A2 and the multifilament yarn B2 are preferably equal.

In the present invention, as a result of the composite yarn being composed of the multifilament yarn A2 and the multifilament yarn B2, the multifilament yarn A2 and the multifilament yarn B2 have a difference in yarn length when the woven/knit fabric is dry, the multifilament yarn B2 having a longer yarn length covers the multifilament yarn A2, and the opening of the structure of the woven/loop of knit fabric is small. On the other hand, during absorption of moisture and water, the multifilament yarn A2 of the woven/knit fabric stretches causing the difference in yarn length with the multifilament yarn B2 to decrease, the lengths of the multifilament yarn A2 and the multifilament yarn B2 are drawn up, and the opening of the woven/loop of knit fabric becomes larger resulting in improved air permeability.

In addition, in the present invention, the drying shrinkage stress (DS value) of the multifilament yarn A2 is preferably 0.08 cN/dtex or more. Furthermore, the drying shrinkage stress (DS value) indicates the shrinkage stress generated when drying following absorption of moisture and humidity, and refers to the stress when the multifilament yarn A2 that has stretched during absorption of moisture and water returns to its original length when dry in opposition to the interstructural constraint force of the woven/knit fabric. In the case this drying shrinkage stress is 0.08 cN/dtex or more, the reversible change in yarn length during absorption of moisture and water and when dry increases, while if the drying shrinkage stress is less than 0.08 cN/dtex, even if the woven/knit fabric that has absorbed moisture and water has dried, the multifilament yarn A2 has difficulty in returning to its original length, and air permeability does not return to its original state prior to absorption of moisture and water, thereby resulting in increased likelihood of inferior reversible air permeability.

Moreover, in the present invention, the prescribed water content of the multifilament yarn A2 is preferably 4% or more. If the prescribed water content is less than 4%, there is little change in yarn length due to the low affinity for water, and since the rate of that change is also low, the amount of change in air permeability in the case of forming into a woven/knit fabric tends to be low.

Examples of forms of composite yarns of the multifilament yarn A2 and the multifilament yarn B2, including double yarns, include plied yarn, covered yarn, mixed-weave yarn, fluid-textured yarn, false-twist textured yarn and combinations thereof. The blending ratio of the multifilament yarn A2 in the composite yarn is preferably 30 to 90% by weight. If the blending ratio is less than 30% by weight, the shrinkage force when dry becomes relatively small and reversibility of air permeability tends to be inadequate. If the blending ratio exceeds 90% by weight, although shrinkage force when dry increases, the structural constraint points of the woven/knit fabric tend to move easily, which is undesirable in terms of dimensional stability.

The woven/knit fabric of the present invention contains a composite yarn composed of the aforementioned multifilament yarn A2 and multifilament yarn B2, and the woven/knit fabric of the present invention preferably contains 20% by weight or more of the composite yarn in terms of effectively adjusting air permeability. If the amount of composite yarn contained is less than 20% by weight, it becomes difficult to obtain an adequate change in air permeability.

In addition, although the woven/knit fabric in the present invention is most preferably a knit fabric formed with coarse weight per square per meter loops of the composite yarn, in consideration of practicality such as cost, air permeability effects, dimensional stability of the woven/knit fabric, durability, and the like, as well as in consideration of effective utilization of composite yarn performance, the woven/knit fabric can be a woven/knit fabric having a suitable structure in which the structure is woven or knit.

As an example thereof, a woven/knit fabric having a multilayer structure composed of a surface layer and a back layer or a surface layer, an intermediate layer, and a back layer allows changes in structure, weight per square per meter, and the like to be obtained easily, and is a preferable woven/knit composition for solving the problems with the present invention. In order to obtain a change in air permeability, the composite yarn of the present invention is distributed in at least one layer, and coarse and fine composite yarns having different densities may be combined.

In the case described above, the composite yarn is preferably contained at 30% by weight or more. If contained at less than 30% by weight, it becomes difficult to obtain the effects of reversible air permeability. Furthermore, calculation of weight ratio is determined as the weight ratio of the composite yarn contained in the back layer of the woven/knit fabric. Here, classification of the yarn composing the surface layer and the back layer or the surface layer, intermediate layer and back layer is based on an assessment of the yarn contained in the greatest amount in each layer. For example, even if a large amount of yarn protruding from the surface layer composes a portion of the back layer, each yarn that composes the surface layer, intermediate layer and back layer is classified by judging that yarn to compose the surface layer.

In the case of the composite yarn being distributed mainly on the surface of a multilayer-structured woven/knit fabric, the woven/knit fabric may be made to be in the form of a cloth that promotes perspiration absorption and rapid-drying effects while obtaining reversible air permeability through the use of capillary action by using a filament such as another fiber material in the back layer.

In addition, in the case of mainly distributing the composite yarn in the back layer of a multilayer-structured woven/knit fabric, it is effective to form a multilayer-structured woven/knit fabric by mainly distributing the composite yarn on the side of the skin where perspiring occurs, namely in the back layer, particularly in the case of clothing. The composite yarn may also be partially used in this manner for clothing parts. If such a multilayer-structured woven/knit fabric is obtained, moisture and perspiration generated by the body are rapidly absorbed by the multifilament yarn A2 of the composite yarn distributed in the back layer, and since air permeability increases as a result of stretching of the multifilament yarn A2, the resulting hot and steamy sensation as well as stickiness are eliminated.

Moreover, when the woven/knit fabric is dried after the aforementioned hot and steamy sensation and stickiness have been eliminated, the multifilament yarn A2 shrinks, air permeability again becomes small, thereby allowing the obtaining of a woven/knit fabric having both effective reversible air permeability and water absorption property.

In this case, the surface layer preferably has a structure that inhibits the degree of freedom of the woven/knit fabric in the manner of a heavy fabric or high-weight per square per meter fabric from the viewpoint of obtaining a difference in air permeability.

In addition, the woven/knit fabric of the present invention may also be a woven/knit fabric obtained by union woven or knit using an arrangement of the aforementioned composite yarn and another filament yarn, spun yarn, or the like that does not exhibit a change in yarn length as a result of absorbing moisture and water. The combined use of the woven/knit fabric of the present invention with another filament yarn or spun yarn and the like is desirable in terms of improving dimensional stability, and is therefore preferable provided it is within a range that allows the obtaining of reversible air permeability.

In the present invention, the weight per square per meter of the woven/knit fabric when dry is preferably 100 to 350 g/m$^2$. Although the reversible change in air permeability increases the greater the degree of freedom of the fibers in the woven/knit fabric and the greater the space within the woven/knit fabric, if the weight per square per meter is less than 100 g/m$^2$, the dimensional stability of the woven/knit fabric tends to be poor, while if the weight per square per meter exceeds 350 g/m$^2$, the weight per square per meter of the woven/knit fabric becomes excessively high, thereby causing the change in air permeability due to moisture absorption to be inadequate, making it difficult to prevent a hot and steamy sensation, stickiness and rises in temperature when perspiring, and resulting in increased susceptibility to a decrease in the drying rate.

Moreover, the amount of the change in air permeability as determined according to the formula below of the woven/knit fabric of the present invention is preferably 10% or more, while the initial air permeability of the woven/knit fabric when dry is preferably 350 cm$^3$/cm$^2$/sec or less.

$$\text{Amount of change in air permeability (\%)}=\{[(\text{air permeability at water content of 50\% by weight})-(\text{initial air permeability when dry})]/(\text{initial permeability when dry})\}\times 100$$

If the amount of change in air permeability is less than 10%, it becomes difficult to feel the change in air permeability. In addition, if the initial air permeability exceeds 350 cm$^3$/cm$^2$/sec, since the level of air permeability is adequately high from the outset, it is no longer necessary to aggressively change air permeability, while also resulting in increased susceptibility to dimensional instability of the woven/knit fabric.

Furthermore, air permeability at a water content of 50% by weight as referred to in the present invention indicates air permeability when the water content of the woven/knit fabric that has been immersed in water for 5 minutes followed by dehydration and air-drying is 50% by weight, while air permeability when dry indicates air permeability when the moisture content has reached equilibrium under conditions of a temperature of 25° C. and humidity of 65% RH.

Although air permeability in response to an atmospheric change is ordinarily determined by determining the difference in air permeability between a high humidity and low humidity atmosphere corresponding to a change in humidity, in the present invention, attention is focused on the water content of the woven/knit fabric in the form of a response to a change in water instead of a change in humidity based on the premise of practicality such as exercising while generating high levels of perspiration in clothing in particular, and measurement conditions were set by using the air permeability of a woven/knit fabric at a water content of 50% by weight for the air permeability during absorption of moisture and water for reasons such as perceiving a hot and steamy sensation and stickiness within the clothing when the clothing has absorbed moisture and water, and reducing the effects on measurement accuracy attributable to moisture adhered to loops during measurement of air permeability.

The following provides an explanation of an example of the woven/knit fabric production process of the present invention.

The multifilament yarn A2 contained in the composite yarn of the present invention is preferably composed of a polymer having functional groups with satisfactory moisture affinity, is preferably composed of a polymer having a large number of hydrophilic functional groups such as a hydroxy group (—OH), carboxy group (—COOH) or acid amide group (—CONH), and is particularly preferably composed of a polymer having a large number of hydroxy groups (—OH).

A multifilament yarn of regenerated fibers such as rayon or cuprammonium rayon, or cellulose-based or cellulose ester-based fibers in which these regenerated fibers are suitably substituted with other hydrophilic functional groups, is preferably used for the multifilament yarn A2 from such a polymer having a large number of functional groups. In addition, examples of cellulose ester-based polymers include cellulose acetate, cellulose propionate, cellulose acetate propionate, cellulose butyrate, and the like. These can be used as is, or may be used after suitably substituting the ester groups for hydroxy groups to improve moisture and water absorption performance. In the case of using the most commonly produced cellulose acetate, a multifilament yarn of the resulting fibers is used preferably by selecting the degree of substitution of acetyl groups by hydroxy groups, and a cellulose-based multifilament yarn obtained by deacetylating cellulose acetate is used particularly preferably for the multifilament yarn A2 in the present invention.

Cellulose acetate is a cellulose derivative in which all or a portion of the hydroxy groups of the cellulose are substituted with acetyl groups, the theoretical upper limit of the degree of substitution is 3.00, and includes various types of cellulose acetate ranging from cellulose acetate having a mean degree of substitution of 2.76 or more referred to as highly substituted cellulose acetate to cellulose acetate having a mean degree of substitution of less than 2.60 or simply acetate referred to as lowly substituted cellulose acetate.

Although acetyl groups in cellulose acetate multifilament yarn is conventionally known to form hydroxy groups as a result of deacetylating by treating with base, since deacetylation is easier to a certain degree with a low degree of acetylation, a cellulose diacetate multifilament yarn is preferably used as precursor fiber of the cellulose-based multifilament yarn preferably used in the present invention. Although the method used for deacetylation treatment is suitably set based on the relationship between the type of base and the treatment temperature and time, the effect on physical properties of the yarn is preferably held to a minimum in order to maintain the allowable strength of the finished product.

An example of a preferable method for deacetylating the cellulose diacetate multifilament yarn of the precursor fiber in the present invention consists of forming hydroxy groups by carrying out deacetylation treatment by treating with base under low-temperature conditions of 60 to 90° C. using a 1 g/L aqueous sodium hydroxide. Although deacetylation proceeds from the surface of the fibers, carrying out deacetylation to a mean degree of substitution of 0.6 or less or substantially carrying out deacetylation completely to the inside of the fibers is preferable since the reversible increase in length during absorption of moisture and humidity becomes larger. The rate of change in the difference in yarn length during absorption of moisture and water with respect to water as well as drying shrinkage stress are effectively improved due to disturbances in fiber structure occurring at this time and due to the effects of increasing the number of hydroxy groups inherently present.

In addition, a thermoplastic multifilament yarn having thermosetting properties is preferable for the multifilament yarn B2, examples of which include polyester multifilament yarn having terephthalic acid as the main acid component thereof and having at least one type of alkylene glycol, and preferably ethylene glycol, trimethylene glycol or tetramethylene glycol, as the main glycol component thereof; denatured polyester multifilament yarns thereof substituted with functional groups; and cellulose triacetate multifilament yarn having a mean degree of substitution of 2.76 or more, with low-shrinkage or spontaneously stretching polyester multifilament yarn having a boiling water shrinkage rate of 5% or less, and preferably 3% or less, being used preferably from the viewpoints of thermosetting properties and heat shrinkage characteristics, while also enabling improvement of dimensional stability when formed into a woven/knit fabric.

The following provides a detailed explanation of a polyester-based compound fiber production process of the present invention.

In the present invention, there is a difference in yarn length between the multifilament yarn A2 and the multifilament yarn B2 when dry, and multifilament yarn B2 is required to be longer. Consequently, examples of methods for imparting this difference in yarn length include a method in which the supplied amount of multifilament yarn B2 is made to be greater than that of multifilament yarn A2 when compounding multifilament yarn A1 and multifilament yarn B1 by covering, fluid-texturing, false-twist texturing, or the like to obtain a composite yarn in which there is a difference in yarn length between multifilament yarn A1 and multifilament yarn B1, a method for forming a woven/knit fabric by drawing up the yarn during weaving or knitting, a method in which the multifilament yarn A1 and the multifilament yarn B1 are plied at an equal supply volume by plying and the like, plying is carried out at a twist factor K of 1000 to 15000 ($K=T\times\sqrt{(D/1.1)}$, where T: number of twists and D: fineness (dtex)) to obtain a composite yarn followed by post-treatment to shrink multifilament yarn A' more than multifilament yarn B', and a method for stretching multifilament yarn B' more than multifilament yarn A'. In addition, in the case of expressing a difference in yarn length following the obtaining of a composite yarn, a difference in yarn length may be imparted in the state in which the composite yarn has been formed into a woven/knit fabric, and these methods may also be used in combination.

For example, in the case of obtaining an interlaced composite yarn having a difference in yarn length between multifilament yarn A1 and multifilament yarn B1 by using a continuously spun rayon multifilament yarn for multifilament yarn A1 and using a spontaneously stretching polyester multifilament yarn for multifilament yarn B1, although such a yarn can be obtained by suitably adjusting various conditions such as the texturing rate and pressure of the interlacing nozzles, the overfeed rate of the multifilament yarn B1 is preferably made to be 0.5 to 6%. If the overfeed rate is less than 0.5%, there is increased susceptibility to the occurrence of defective interlacing, while if the overfeed rate exceeds 6%, there tends to be defective passage of the yarn through the process.

In addition, multifilament yarn A1 and multifilament yarn B1 are preferably formed into a composite yarn by carrying out plying at a twist factor K of 1000 to 15000 ($K=T\times\sqrt{(D/1.1)}$, where T: number of twists and D: fineness (dtex)). If the twist factor K is less than 1000, unraveling tends to occur easily, while if twist factor K exceeds 15000, constraint force becomes excessively high making it difficult to express a difference in yarn length and preventing obtaining of the target air permeability.

In addition, effectively imparting a difference in yarn length by using an interlaced composite yarn, in which a cellulose diacetate multifilament yarn having a mean degree of substitution of 2.4 as the precursor fibers of multifilament yarn A1 and a spontaneously stretching polyester multifilament yarn as multifilament yarn B1 are supplied at an equal yarn length to obtain a woven/knit fabric, followed by treating the woven/knit fabric with base and deacetylating the precursor fibers to shrink in the lengthwise direction together with stretching the spontaneously stretching polyester multifilament yarn during dyeing and post-texturing, is preferable in terms of passing property of yarn through the process free of fluffing, yarn breaking, and the like in preparing steps such as twisting, warping, and the like and weaving and knitting steps.

In the case of carrying out dyeing treatment on a woven/knit fabric, treatment is preferably carried out at a temperature of 100 to 130° C. If the dyeing treatment temperature is lower than 100° C., expression of yarn shrinkage or spontaneous stretching becomes inadequate, thereby preventing the obtaining of an adequate difference in yarn length. In addition, if the dyeing treatment temperature exceeds 130° C., it becomes difficult to combine colors by discharge of dye.

The set state of the multifilament yarn A' is important during finishing as a woven/knit fabric. Since multifilament yarn A stretches when moisture and water are absorbed during dyeing, unless the yarn length of multifilament yarn A' is made to be as short as possible by allowing dry shrinkage during final drying to be adequately demonstrated, the resulting woven/knit fabric ends up having inferior air permeability and dimensional stability.

The finishing treatment temperature is preferably 100 to 200° C. If the finishing treatment temperature is lower than 100° C., setting becomes considerably poor thereby preventing the target difference in air permeability from being obtained. In addition, if the finishing treatment temperature exceeds 200° C., partial adhesion between fibers tends to occur easily, thereby preventing the demonstration of a change in air permeability.

In addition, in the case of deesterifying the precursor fibers, the reaction is carried out in the presence of moisture, and the deesterified cellulose side swells and stretches due to the moisture. It is extremely important to select a texturing step that allows dry shrinkage during final drying to be adequately demonstrated. In other words, it is necessary to design steps such as the dry finishing step based on the required maximum shrunk fabric weight per square per meter by drying without applying tension to the end of the deesterified woven fabric.

Although the finishing setting conditions are based on the balance with the final finished surface processing in terms of dyeing wrinkles, texture, and the like, the maximum shrunk fabric weight per square per meter is generally set to be within 0.85 times, preferably within 0.90 times and more preferably within 0.95 times in terms of dimensional stability. In other words, even though there is a difference in yarn length with the multifilament yarn B', in the case of having carried out final set drying in the state in which the multifilament yarn A' is been excessively stretched, although there is a difference in yarn length with the multifilament yarn B', reversible air permeability performance is expressed by the woven/knit fabric since the multifilament yarn A' is dried while applying tension. However, since the yarn length of the multifilament yarn A' stabilizes in the shortest possible state comparatively freely during a change from the stretched state during absorption of moisture and water to the shrunken state when dry, the resulting woven/knit fabric has inferior dimensional stability. In addition, in the case of final set drying in the state in which the multifilament yarn A' has been stretched excessively in the absence of a difference in yarn length with the multifilament yarn B', it becomes difficult to express the reversible air permeability performance of the woven/knit fabric.

Moreover, in the present invention, the fiber surface of the woven/knit fabric of the present invention is preferably subjected to water repellency treatment to a level of water repellency of 3 or more to obtain a change in air permeability caused by moisture from the inside of the woven/knit fabric while preventing entry of water into the woven/knit fabric from the outside. If the level of water repellency is lower than 3, water from the outside penetrates into the fabric causing enlargement of the loops of the fabric, thereby resulting in a decrease in heat retention. Furthermore, a known water repellent such as a silicon-based water repellent or fluorine-based water repellent is used for the water repellent for carrying out water repellency treatment, and a typically carried out known method such as a padding method or spray method is used for the processing treatment thereof. Processing conditions such as the amount of water repellent adhered to the woven/knit fabric, treatment temperature, and treatment time can be suitably selected for the treatment conditions of water repellency processing provided the level of water repellency is 3 or higher.

In addition, in the present invention, rubbing treatment is preferably carried out after carrying out water repellency treatment on the fiber surface. In the case of ordinary water repellency treatment in the form of coating or lamination, there are cases in which constraint occurs between the fibers thereby inhibiting reversible changes. Although it is therefore necessary to perform water repellency treatment on only the surface of monofilaments as much as possible, since water repellent excessively penetrates and adheres to not only the surfaces of monofilaments but also the gaps between monofilaments and the gaps of the interlaced points causing impairment of movement between the monofilaments, or in other words, impairment of the degree of freedom, it is preferable to remove any constrained points between the monofilaments by rubbing treatment using a tumbler or cam roller.

EXAMPLES

The following provides a more detailed explanation of the present invention through embodiments thereof. Furthermore, measurement and evaluation of various characteristic values contained in the embodiments were carried out according to the methods described below.

(Ratio of Stretching During Moisture and Water Absorption to Stretching When Dry)

In order to eliminate the effects of oil adhered to the woven/knit fabric, the woven/knit fabric was scoured under the conditions described below followed by arranging on a piece of filter paper, air-drying for 10 hours or more at a temperature of 25° C. and 65% humidity, taking out the woven/knit fabric while being careful not to apply tension to the composite yarn used in the woven/knit fabric, separating multifilament yarn A2 and multifilament yarn B2 into roughly 5 cm fragments and using those fragments as samples. At this time, samples were obtained after dyeing in a single tank to facilitate separation.

Scouring conditions: 0.2% by weight aqueous solution of Scourol 900 scouring agent (Kao Corp.), liquor ratio: 1:100, immersed for 30 minutes at 80° C.

The prepared samples were placed in a top clamp, an initial load that prevents the effects of yarn bending (fiber dtex/1.1×1/30 g) was applied, and the yarn length (L1) when dry between the top clamp and the installation of the initial load was visually determined as the fiber length using a stainless steel straight ruler. Next, the top clamp and the sample with the initial load still applied were immersed for 5 minutes in the horizontal direction in a water tank followed by taking out of the water, wiping off any excess moisture adhered to the surface with a piece of filter paper, and determining the yarn length (L2) during moisture and water absorption in the same manner as when dry. The stretching ratio of yarn length during moisture and water absorption to yarn length when dry was determined from the yarn length (L1) when dry and the yarn length (L2) during moisture and humidity absorption according to the formula below.

Stretching ratio of yarn length during moisture and water absorption to yarn length when dry=(L2−L1)/L1

(Shrinkage Stress from Moisture and Water Absorption to Drying)

After immersing the samples in water for 5 minutes, the samples were removed from the water and excess moisture adhered to the surface was wiped off with a piece of filter paper. An initial load (fiber dtex/1.1×1/30 g) was applied using the Tensilon Model UTM-II-20 (A & D Co., Ltd., load cell TLU-0.2L-F-II, 200 G), the test length was defined to be 30 mm, the samples were placed in a chuck and shrinkage stress during drying was measured while drying under conditions of 25° C. and 65% humidity.

(Air Permeability)

Initial air permeability ($cm^3/cm^2/sec$) of the woven/knit fabric when equilibrated at 25° C. and 65% humidity and wet air permeability ($cm^3/cm^2/sec$) of the woven/knit fabric at a water content of 50% were determined by measuring with the FX3300 air permeability tester manufactured by Textest AG in accordance with the general testing methods of JIS L1018 (Fragile Testing) in a variable environment chamber at 25° C. and 65% humidity. In addition, in order to confirm reversibility when the woven/knit fabric was allowed to absorb moisture and water following by drying again, repeat drying air permeability ($cm^3/cm^2/sec$) was determined when the woven/knit fabric was re-measured when equilibrated at 25° C. and 65% humidity after measuring the woven/knit fabric at a water content of 50%.

(Water Repellency Level)

The level of water repellency was measured in accordance with the general testing methods of JIS L1092 (spray testing).

(Permeability)

Five $cm^3$ of water were dropped from above onto a sample in which the resulting woven/knit fabric was layered on top and filter paper was layered on the bottom, and 30 seconds later the absence of permeation into the filter paper was evaluated with "Good", while the presence of permeation was evaluated with "Not good".

(Steamy Sensation/Stickiness)

An article of sportswear was fabricated from the resulting woven/knit fabric, and a steamy sensation and stickiness were functionally evaluated by a person wearing the sportswear after running for 1 hour. The absence of a steamy sensation or stickiness was evaluated with "Good", while the presence of a steamy sensation or stickiness was evaluated with "Not good".

Example 1

A cellulose diacetate multifilament yarn (Mitsubishi Rayon Co., Ltd., Bright 135 dtex/32 filament (to be abbreviated as "f") having a mean degree of substitution of 2.41 was used for multifilament yarn A1, a cellulose triacetate multifilament yarn (Mitsubishi Rayon Co., Ltd., Bright 184 dtex/20 f) having a mean degree of substitution of 2.91 was used for multifilament yarn B1, and multifilament yarn B1 was supplied to multifilament yarn A1 at an overfeed rate of 1.0% to fabricate a composite yarn (fineness: 210 dtex, degree of interlacing: 52/m) by interlaced mixed weaving followed by knitting a 30-inch, 22-gauge reversible knit fabric under the conditions indicated below.

Knit structure: Surface layer and back layer have a long-knit structure and the nodes a tacked 1/1 on both sides Yarn composition: Surface layer consists of 167 dtex/48 f polyester multifilament yarn, tacks consist of 56 dtex/24 f polyester multifilament yarn, and back layer consists of the aforementioned mixed-weave yarn The knitted reversible knit fabric was subjected to deacetylation treatment under conditions in which deacetylation is carried out only on the cellulose diacetate multifilament yarn having a mean degree of substitution of 2.41 of multifilament yarn A1 according to the alkaline treatment conditions indicated below, the multifilament yarn A' contained therein was denatured, and yarn was single-tank dyed by direct dyeing at 120° C., and allowed to state while allowing to adequately shrink under conditions such that tension is not applied during drying. This set dyed knit fabric was then immersed according to the padding method using fluorine-based water repellent composed of perfluoroalkylacrylate copolymer and pressed with a mangle followed by carrying out final water repellency treatment by thermosetting for 3 minutes with a tenter at 170° C. The finishing setting conditions consisted of carrying out setting at a maximum shrunk fabric weight per square per meter of 0.90 times in balance with final finished surface texture such as dyeing wrinkles. The weight per square per meter of the resulting knit fabric was 270 $g/m^2$.

(Alkaline Treatment Conditions)

Alkaline treatment solution: 1% by weight aqueous sodium hydroxide

Treatment liquor ratio: 1:100

Treatment temperature: 60° C.

Treatment time: 15 minutes

As a result of unraveling the aforementioned composite yarn from the resulting knit fabric, extracting the separately dyed monofilaments and determining the fiber characteristics, the multifilament yarn A2, obtained by deacetylation using cellulose diacetate multifilament yarn having a mean degree of substitution of 2.41 for the multifilament yarn A1, was deweighted to a fineness of 81 dtex, the stretching ratio of the yarn during moisture and water absorption was 1.11 times, namely the yarn length during absorption of moisture and water reversibly stretched by 1.11 times the yarn length when dry, the shrinkage stress during drying was 0.13 cN/dtex, and the prescribed water content was 12.3%. In addition, the cellulose triacetate multifilament yarn having a mean degree of substitution of 2.91 in the form of multifilament yarn B1 did not decrease in fineness under the alkaline treatment conditions described above, and deacetylation was not observed. The stretching ratio of this multifilament yarn B2 during absorption of moisture and water was 1.005 times, the shrinkage stress during drying was 0.02 cN/dtex, and the prescribed water content was 3.5%. The yarn length (WA2) of the multifilament yarn A2 during absorption of moisture and water per 3 cm of composite yarn during drying was 3.3 cm, the yarn length (DB2) of the multifilament yarn B2 during drying was 3.5 cm, and the ratio of WA2/DB2 was 0.94.

The evaluation results of the resulting knit fabric are shown in Table 1.

In addition to absorbing water due to the high water absorbency of the multifilament yarn A2 of the composite yarn contained in the back layer thereof, the resulting knit fabric underwent a change in air permeability of the fabric as a result of a rapid change in the yarn length thereof in response to humidity, and was free of any steamy sensation or stickiness during test wearing.

Comparative Example 1

Dyeing, setting, water repellency treatment, and rubbing treatment were carried out in the same manner as Example 1 with the exception of using a mixed-weave yarn, consisting of a high-count polyester multifilament yarn (Mitsubishi Rayon Co., Ltd., Semidal 66 dtex/136 f, boiling water shrinkage rate: 7.5%) for multifilament yarn A1 and a spontaneously stretching polyester multifilament yarn produced according to the production process described in Japanese Patent No. 2829893 (Mitsubishi Rayon Co., Ltd., Semidal 90 dtex/72 f, boiling water shrinkage rate: −0.7%, 180° C. drying shrinkage rate after boiling water treatment: 2.0%) for multifilament yarn B1, for the yarn composing the back layer, weaving and carrying out alkaline deweighting treatment at a deweighting ratio of 12%. The weight per square per meter of the resulting knit fabric was 290 g/m$^2$. The multifilament yarns A2 and B2 in the knit fabric hardly stretched at all as a result of absorption of moisture and water, and there was no generation of shrinkage stress accompanying drying. In addition, the prescribed water content was 0.4% for both multifilament yarns. In addition, the yarn length (WA2) of the multifilament yarn A2 during absorption of moisture and water per 3 cm of composite yarn during drying was 3.1 cm, the yarn length (DB2) of the multifilament yarn B2 during drying was 3.3 cm, and the ratio of WA2/DB2 was 0.94. The evaluation results of the resulting knit fabric are shown in Table 1. Since the resulting knit fabric demonstrates hardly any moisture absorption property, and air permeability does not change in response to humidity, both a steamy sensation and stickiness were perceived when perspiring.

Example 2

A 2-ply, 30-inch, 14-gauge jersey knit fabric was knitted by using a continuously spun rayon multifilament yarn (Bright 133 dtex/48 f, boiling water shrinkage rate: 6.5%) for multifilament yarn A1, using a spontaneously stretching polyester multifilament yarn produced according to the production process described in Japanese Patent No. 2829893 (Mitsubishi Rayon Co., Ltd., Semidal 90 dtex/72 f, boiling water shrinkage rate: −0.7%, 180° C. drying shrinkage rate after boiling water treatment: 2.0%) for multifilament yarn B1, supplying B1 to multifilament yarn A1 at an overfeed rate of 2.0% and carrying out interlaced mixed-weaving to fabricate a composite yarn (fineness: 220 dtex, degree of interlacing: 70/m).

After single-tank dyeing the knit fabric by direct dyeing at 120° C., the fabric was set in a state in which multifilament yarn A' was allowed to adequately shrink under conditions such that tension is not applied during drying, followed by carrying out water repellency treatment in the same manner as Example 1 and carrying out rubbing treatment with a tumbler to remove any constrained points between the monofilaments. The finishing setting conditions consisted of carrying out setting at a maximum shrunk fabric weight per square per meter of 0.93 times in balance with final finished surface texture such as dyeing wrinkles. The weight per square per meter of the resulting knit fabric was 260 g/m$^2$. As a result of unraveling the aforementioned composite yarn from the resulting knit fabric, extracting the separately dyed monofilaments and determining the fiber characteristics, the multifilament yarn A2 exhibited a stretching ratio during moisture and water absorption of 1.034 times, the shrinkage stress during drying was 0.11 cN/dtex, and the prescribed water content was 11%. The stretching ratio of the multifilament yarn B2 during absorption of moisture and water was 1.004 times, only stretching slightly as a result of absorption of moisture and water, and there was no generation of shrinkage stress accompanying drying. In addition, the prescribed water content was 0.4%. In addition, the yarn length (WA2) of the multifilament yarn A2 during absorption of moisture and water per 3 cm of composite yarn during drying was 3.1 cm, the yarn length (DB2) of the multifilament yarn B2 during drying was 3.4 cm, and the ratio of WA2/DB2 was 0.91.

The evaluation results of the resulting knit fabric are shown in Table 1.

In addition to absorbing water due to the high water absorbency of the multifilament yarn A2 of the composite yarn used in this knit fabric, the resulting knit fabric underwent a change in yarn length due to the presence of moisture, and was free of any steamy sensation or stickiness during test wearing.

Comparative Example 2

After single-tank dyeing by direct dyeing at 120° C. in Example 2, tentering was carried out under conditions such that excess tension was applied during drying to reduce thickness, the multifilament yarn A1 was set while in the stretched state, and water repellency treatment and rubbing treatment were carried out in the same manner as Example 1. The finishing setting conditions consisted of carrying out setting at a maximum shrunk fabric weight per square per meter of 0.80 times in balance with final finished surface texture such as dyeing wrinkles. The weight per square per meter of the resulting knit fabric was 210 g/m$^2$. As a result of extracting the separately dyed monofilaments and determining the fiber characteristics, the multifilament yarn A2 exhibited a stretching ratio during moisture and water absorption of 1.011 times and shrunk by 4% during drying. The stretching ratio of the multifilament yarn B2 during absorption of moisture and water was 1.004 times, only stretching slightly as a result of absorption of moisture and water, while stretching during drying did not occur and was unable to be measured, and the prescribed water content was 0.4%. The lower reversible stretching ratio during absorption of moisture and water as compared with the composite yarn of Example 2 is presumed to be the result of multifilament yarn A' being set under tension without being adequately stretched during setting of the knit fabric. The yarn length (WA2) of the multifilament yarn A2 during absorption of moisture and water per 3 cm of composite yarn during drying was 3.1 cm, the yarn length (DB2) of the multifilament yarn B2 during drying was 3.1 cm, and the ratio of WA2/DB2 was 1.0.

The evaluation results of the resulting knit fabric are shown in Table 1.

Although the resulting knit fabric absorbs moisture during initial perspiration since the continuously spun rayon multifilament fiber of multifilament yarn A2 has suitable moisture absorption property, in the state of having absorbed moisture and water, there is little change in the yarn length of multifilament yarn A2 resulting in an inferior change in air permeability, thereby causing a steamy sensation and stickiness to be perceived. In addition, there was also the problem of the occurrence of a change in the form of the knit fabric accompanying shrinkage of the continuously spun rayon multifilament yarn of multifilament yarn A2 during drying.

Comparative Example 3

A 2-ply, 30-inch, 14-gauge jersey knit fabric was knitted by using a highly stretchable polyester multifilament yarn (Mitsubishi Rayon Co., Ltd., Semidal 84 dtex/36 f, boiling water shrinkage rate: 19.1%) for multifilament yarn B1 in Example 2, supplying B1 to multifilament yarn A1 at an overfeed rate of 1.0%, fabricating a composite yarn (fineness: 211 dtex, degree of interlacing: 41/m) by interlaced mixed-weaving, and carrying out dyeing, setting, water repellency treatment and rubbing treatment in the same manner as Example 2. The finishing setting conditions consisted of carrying out setting at a maximum shrunk fabric weight per square per meter of 0.90 times in balance with final finished surface texture such as dyeing wrinkles. The weight per square per meter of the resulting knit fabric was 340 g/m$^2$. The multifilament yarn B2 in the composite yarn was hardly stretched at all by absorption of moisture and water, and since there was no occurrence of shrinking during drying, shrinkage was unable to be measured. The prescribed water content was 0.4%. The yarn length (WA2) of the multifilament yarn A2 during absorption of moisture and water per 3 cm of composite yarn during drying was 3.6 cm, the yarn length (DB2) of the multifilament yarn B2 during drying was 2.9 cm, and the ratio of WA2/DB2 was 1.24.

The evaluation results of the resulting knit fabric are shown in Table 1.

Although the resulting knit fabric absorbs humidity during initial perspiration since the continuously spun rayon multifilament fiber of multifilament yarn A2 has suitable moisture absorption property, in the state of having absorbed moisture and water, the mesh becomes blocked due to stretching of multifilament yarn A2 resulting in a decrease in air permeability and perception of a steamy sensation and stickiness.

Example 3

A jersey knit fabric was knitted in the same manner as Example 2 with the exception of using a cellulose diacetate multifilament yarn (Mitsubishi Rayon Co., Ltd., Bright 135 dtex/32 f) having a mean degree of substitution of 2.41 for multifilament yarn A1, using regular polyester multifilament yarn (Mitsubishi Rayon Co., Ltd., Semidal 56 dtex/24 f, boiling water shrinkage rate: 7.8%) for multifilament yarn B1, carrying out plying at a twist factor K=4167 (S twist 300 t/m) to form a composite yarn (fineness: 193 dtex) and using the composite yarn, followed by carrying out alkaline treatment, single-tank dyeing, setting, water repellency treatment and rubbing treatment in the same manner as Example 1. The weight per square per meter of the resulting knit fabric was 200 g/m$^2$.

As a result of unraveling the aforementioned composite yarn from the resulting knit fabric and extracting each separately dyed component, the multifilament yarn A2 obtained by deacetylating the cellulose diacetate multifilament yarn A1 was deweighted to a fineness of 81 dtex, reversibly stretched during absorption of moisture and water by 1.24 times that during drying, the shrinkage stress during drying was 0.13 cN/dtex and the prescribed water content was 13.0%. The large reversible stretching rate during absorption of moisture and water as compared with Example 2 is presumed be the result of the appearance of considerable shrinkage due to the alkaline treatment of deacetylation since the yarn was not interlaced with monofilaments. The stretching ratio of the multifilament yarn B2 during absorption of moisture and water was 1.004 times, and since there was no occurrence of shrinkage during drying, shrinkage was unable to be measured, and the prescribed water content was 0.4%. The yarn length (WA2) of the multifilament yarn A2 during absorption of moisture and water per 3 cm of composite yarn during drying was 3.7 cm, the yarn length (DB2) of the multifilament yarn B2 during drying was 3.6 cm, and the ratio of WA2/DB2 was 1.03.

The evaluation results of the resulting knit fabric are shown in Table 1.

In addition to absorbing water due to the high water absorbency of the cellulose-based multifilament yarn A2 of the composite yarn used in the back layer, the resulting knit fabric underwent a change in air permeability as a result of a rapid change in the yarn length due to the presence of humidity, and was free of any steamy sensation or stickiness during test wearing.

Example 4

Cellulose triacetate having a degree of substitution of 2.91 and cellulose diacetate having a degree of substitution of 2.41 were respectively dissolved in a mixed solvent of 91% by weight of methylene chloride and 9% by weight of methanol to prepare a raw spinning solution containing 22% by weight of cellulose triacetate and a raw spinning solution containing 22% by weight of cellulose diacetate. The cellulose diacetate component and the cellulose triacetate component were compound-spun by dry spinning using these raw spinning solutions at 50:50 side-by-side to obtain 84 dtex/30 f multifilament yarn A1.

Using the aforementioned multifilament yarn A1 and a spontaneously stretching polyester multifilament yarn produced according to the production process described in Japanese Patent No. 2829893 (Mitsubishi Rayon Co., Ltd., Semidal 56 dtex/48 f, boiling water shrinkage rate: −0.7%, 180° C. drying shrinkage rate after boiling water treatment: 1.8%) for multifilament yarn B1, multifilament yarn B2 was supplied to multifilament yarn A1 at an overfeed rate of 1.0%, interlaced mixed-weaving was carrying out to fabricate a composite yarn (fineness: 142 dtex, degree of interlacing: 48/m) that was knit into a knit fabric followed by carrying out alkaline treatment, single-tank dyeing, setting, water repellency treatment and rubbing treatment in the same manner as Example 1. The finishing setting conditions consisted of carrying out setting at a maximum shrunk fabric weight per square per meter of 0.95 times in balance with final finished surface texture such as dyeing wrinkles. The weight per square per meter of the resulting knit fabric was 235 g/m$^2$.

As a result of unraveling the aforementioned composite yarn from the resulting knit fabric, extracting the separately dyed monofilaments and determining the fiber characteristics, the multifilament yarn A2, obtained by deacetylating only the diacetate component of multifilament yarn A1, was deweighted to a fineness of 68 dtex, reversibly stretched by 1.04 times as a result of absorption of moisture and water, exhibited shrinkage stress during drying of 0.08 cN/dtex, and had a prescribed water content of 8.0%. Multifilament yarn B2 exhibited a stretching ratio during absorption of moisture and water of 1.004 times, the shrinkage stress during drying was 0.001 or less and unable to be measured, and the prescribed water content of 0.4%. The yarn length (WA2) of the multifilament yarn A2 during absorption of moisture and water per 3 cm of composite yarn during drying was 3.2 cm, the yarn length (DB2) of the multifilament yarn B2 during drying was 3.4 cm, and the ratio of WA2/DB2 was 0.94.

The evaluation results of the resulting knit fabric are shown in Table 1.

In addition to absorbing water due to the high water absorbency of the multifilament yarn A2 of the composite yarn contained in the back layer thereof, apparent fiber length was composed to be even shorter in the composite yarn as a result of being crimped during drying, thereby undergoing a change in air permeability as a result of changing rapidly in response to humidity, and being free of any steamy sensation or stickiness during test wearing.

TABLE 1

| | Amount of change in air permeability (%) | Initial air permeability (cm$^3$/cm$^2$/sec) | Air permeability when wet (cm$^3$/cm$^2$/sec) | Air permeability during repeated drying (cm$^3$/cm$^2$/sec) | Water repellency (level) | Permeability | Steamy sensation/ stickiness |
|---|---|---|---|---|---|---|---|
| Ex. 1 | 54 | 120 | 185 | 125 | 4 | Good | Good |
| Comp. Ex. 1 | 9 | 110 | 120 | 115 | 4 | Good | Not good |
| Ex. 2 | 62 | 240 | 550 | 250 | 3 | Good | Good |
| Comp. Ex. 2 | 8 | 185 | 200 | 170 | 3 | Good | Not good |
| Comp. Ex. 3 | −36 | 280 | 180 | 275 | 3 | Good | Not good |
| Ex. 3 | 80 | 280 | 480 | 290 | 3 | Good | Good |
| Ex. 4 | 64 | 140 | 230 | 145 | 3 | Good | Good |

INDUSTRIAL APPLICABILITY

A woven/knit fabric of the present invention can be preferably used as a clothing material, and particularly as a material for sportswear or casual clothing in which temperature and humidity within the clothing is required to be controlled to constantly maintain a comfortable state. Moreover, in addition to being able to be used throughout an entire clothing product, a woven/knit fabric of the present invention can also be preferably used in a partial material of a product in the form of partial use in the underarms, back, chest and stomach portions of clothing that are susceptible to the perception of perspiration and dampness.

The invention claimed is:

1. At least one of a woven fabric and a knit fabric containing composite yarn comprising a multifilament yarn A2 and a multifilament yarn B2, wherein:

the ratio (WA2/DA2) of the yarn length of the multifilament fiber A2 during absorption of moisture and water (WA2) to the yarn length of the multifilament yarn A2 under conditions of 20° C. and 65% humidity (DA2) is 1.02 to 1.30;

the ratio (WA2/DB2) of the yarn length of the multifilament yarn A2 during absorption of moisture and water (WA2) to the yarn length of the multifilament yarn B2 under conditions of 20° C. and 65% humidity (DB2) is 0.9 to 1.1;

the drying shrinkage stress (DS value) of the multifilament yarn A2 is 0.08 cN/dtex or more;

the multifilament yarn A2 is regenerated fibers;

the multifilament yarn B2 is a polyester multifilament yarn having terephthalic acid as a main component thereof and having at least one alkylene glycol as a main glycol component thereof;

a change in yarn length of the multifilament yarn B2 is 0% when comparing the length under conditions of 20° C. and 65% humidity and the length during absorption of moisture and/or water; and a maximum weight per square meter of the woven fabric or the knit fabric under conditions of 20° C. and 65% humidity is 0.85 times that of the weight per square meter of the woven fabric or the knit fabric during absorption of moisture and/or water.

2. The fabric according to claim 1, wherein said fabric contains 20% by weight or more of the composite yarn, and wherein the weight per square meter of the fabric when dry is 100 to 350 g/m$^2$, wherein:

the amount of change in air permeability is 10% or more: amount of change in air permeability (%)={[(air permeability at water content of 50% by weight)−(initial air permeability when dry)]/(initial permeability when dry)}×100, and the initial air permeability when dry is 350 cm$^3$/cm$^2$/sec or less.

3. The fabric according to claim 1, wherein said regenerated fibers are rayon or cuprammonium rayon.

4. The fabric according to claim 1, wherein said alkylene glycol is at least one selected from the group consisting of ethylene glycol, trimethylene glycol and tetramethylene glycol.

5. At least one of a woven fabric and a knit fabric containing composite yarn comprising a multifilament yarn A2 and a multifilament yarn B2, wherein:

the ratio (WA2/DA2) of the yarn length of the multifilament fiber A2 during absorption of moisture and water (WA2) to the yarn length of the multifilament yarn A2 under conditions of 20° C. and 65% humidity (DA2) is 1.02 to 1.30;

the ratio (WA2/DB2) of the yarn length of the multifilament yarn A2 during absorption of moisture and water (WA2) to the yarn length of the multifilament yarn B2 under conditions of 20° C. and 65% humidity (DB2) is 0.9 to 1.1;

the drying shrinkage stress (DS value) of the multifilament yarn A2 is 0.08 cN/dtex or more;

the multifilament yarn A2 is regenerated fibers; and the multifilament yarn B2 is a cellulose triacetate multifilament yarn that has a mean degree of substitution of 2.76 or more.

6. The fabric according to claim 5, wherein said fabric contains 20% by weight or more of the composite yarn, and wherein the weight per square meter of the fabric when dry is 100 to 350 g/m$^2$, wherein:

the amount of change in air permeability is 10% or more: amount of change in air permeability (%)={[(air permeability at water content of 50% by weight)−(initial air permeability when dry)]/(initial permeability when dry)}×100, and the initial air permeability when dry is 350 cm$^3$/cm$^2$/sec or less.

7. The fabric according to claim 5, wherein said regenerated fibers are rayon or cuprammonium rayon.

8. At least one of a woven fabric and a knit fabric containing composite yarn comprising a multifilament yarn A2 and a multifilament yarn B2, wherein:

the ratio (WA2/DA2) of the yarn length of the multifilament fiber A2 during absorption of moisture and water (WA2) to the yarn length of the multifilament yarn A2 under conditions of 20° C. and 65% humidity (DA2) is 1.02 to 1.30;

the ratio (WA2/DB2) of the yarn length of the multifilament yarn A2 during absorption of moisture and water (WA2) to the yarn length of the multifilament yarn B2 under conditions of 20° C. and 65% humidity (DB2) is 0.9 to 1.1;

the drying shrinkage stress (DS value) of the multifilament yarn A2 is 0.08 cN/dtex or more;

the multifilament yarn A2 is a cellulose-based multifilament yarn obtained by deacetylating cellulose acetate; and the multifilament yarn B2 is a polyester multifilament yarn having terephthalic acid as a main component thereof and having at least one alkylene glycol as a main glycol component thereof.

9. The fabric according to claim 8, wherein said alkylene glycol is at least one selected from the group consisting of ethylene glycol, trimethylene glycol and tetramethylene glycol.

10. At least one of a woven fabric and a knit fabric containing composite yarn comprising a multifilament yarn A2 and a multifilament yarn B2, wherein:

the ratio (WA2/DA2) of the yarn length of the multifilament fiber A2 during absorption of moisture and water (WA2) to the yarn length of the multifilament yarn A2 under conditions of 20° C. and 65% humidity (DA2) is 1.02 to 1.30;

the ratio (WA2/DB2) of the yarn length of the multifilament yarn A2 during absorption of moisture and water (WA2) to the yarn length of the multifilament yarn B2 under conditions of 20° C. and 65% humidity (DB2) is 0.9 to 1.1;

the drying shrinkage stress (DS value) of the multifilament yarn A2 is 0.08 cN/dtex or more;

the multifilament yarn A2 is a cellulose-based multifilament yarn obtained by deacetylating cellulose acetate;

the multifilament yarn B2 is a cellulose triacetate multifilament yarn that has a mean degree of substitution of 2.76 or more; and the multifilament yarns A2 and B2 form the claimed composite yarn by imparting interlacing or plying to the multifilament yarns A2 and B2.

* * * * *